US009446921B2

(12) United States Patent
Habara

(10) Patent No.: US 9,446,921 B2
(45) Date of Patent: Sep. 20, 2016

(54) SHEET PROCESSING APPARATUS HAVING FIRST AND SECOND ALIGNERS CONTROLLED BASED ON COMBINATION OF PREDETERMINED JOB PARAMETERS, AND IMAGE FORMING SYSTEM HAVING SHEET PROCESS APPARATUS

(71) Applicant: KONICA MINOLTA, INC., Chiyoda-ku, Tokyo (JP)

(72) Inventor: Ryosuke Habara, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 44 days.

(21) Appl. No.: 14/301,056

(22) Filed: Jun. 10, 2014

(65) Prior Publication Data

US 2014/0366700 A1 Dec. 18, 2014

(30) Foreign Application Priority Data

Jun. 18, 2013 (JP) ..... 2013-127418

(51) Int. Cl.
*B65H 37/04* (2006.01)
*B65H 5/06* (2006.01)
(Continued)

(52) U.S. Cl.
CPC ..... *B65H 5/062* (2013.01); *B65H 5/26* (2013.01); *B65H 7/00* (2013.01); *B65H 9/008* (2013.01); *B65H 9/101* (2013.01); *B65H 15/02* (2013.01);
(Continued)

(58) Field of Classification Search
CPC ..... B65H 37/04; B65H 37/06
USPC ..... 270/58.09, 58.11, 58.12
See application file for complete search history.

(56) References Cited

U.S. PATENT DOCUMENTS 7,328,893 B2 * 2/2008 Kawatsu ..... B42C 1/12 270/52.17
7,445,208 B2 * 11/2008 Onodera ..... B65H 9/006 271/226

(Continued)

FOREIGN PATENT DOCUMENTS

JP 2001233508 A 8/2001
JP 2007031099 A 2/2007

(Continued)

OTHER PUBLICATIONS

Japanese Office Action and English translation thereof dated Apr. 21, 2015, issued in counterpart Japanese Application No. JP 2013-127418.

(Continued)

*Primary Examiner* — Patrick Mackey
(74) *Attorney, Agent, or Firm* — Holtz, Holtz & Volek PC

(57) ABSTRACT

A sheet processing apparatus including: a first aligner to push lateral edges of a sheet inward across a width direction of the sheet conveyed from an upstream side for alignment of the sheet, the width direction being orthogonal to a moving direction of the sheet; a second aligner to abut a front edge of the sheet conveyed from the upstream side for a predetermined period of time for alignment of the sheet; a first aligner driver to drive the first aligner; a second aligner driver to drive the second aligner; and a controller to control operations of the first aligner driver and the second aligner driver, wherein the controller activates or inactivates the first aligner driver and the second aligner driver depending on a predetermined parameter on the conveyed sheet.

13 Claims, 9 Drawing Sheets

(51) Int. Cl.

| | |
|---|---|
| ***B65H 31/34*** | (2006.01) |
| ***B65H 5/26*** | (2006.01) |
| ***B65H 7/00*** | (2006.01) |
| ***B65H 9/00*** | (2006.01) |
| ***B65H 9/10*** | (2006.01) |
| ***B65H 15/02*** | (2006.01) |
| ***B65H 31/02*** | (2006.01) |
| ***B65H 45/14*** | (2006.01) |
| ***B65H 45/30*** | (2006.01) |
| *B26D 1/24* | (2006.01) |
| *B26D 7/00* | (2006.01) |

(52) U.S. Cl.

CPC ..... *B65H 31/02* (2013.01); *B65H 31/34* (2013.01); *B65H 45/14* (2013.01); *B65H 45/30* (2013.01); *B26D 1/245* (2013.01); *B26D 2007/0018* (2013.01); *B65H 2301/33214* (2013.01); *B65H 2301/33312* (2013.01); *B65H 2301/4213* (2013.01); *B65H 2301/4227* (2013.01); *B65H 2301/42146* (2013.01); *B65H 2404/6111* (2013.01); *B65H 2405/211* (2013.01); *B65H 2511/30* (2013.01); *B65H 2511/414* (2013.01); *B65H 2515/112* (2013.01); *B65H 2551/10* (2013.01); *B65H 2801/27* (2013.01); *B65H 2801/48* (2013.01); *Y10T 83/6539* (2015.04)

(56) References Cited

U.S. PATENT DOCUMENTS

| | | | | |
|---|---|---|---|---|
| 7,810,808 | B2 | 10/2010 | Hamahashi | |
| 7,946,569 | B2 * | 5/2011 | Suzuki | B65H 9/101 270/32 |
| 8,382,089 | B2 * | 2/2013 | Yonekawa | B26D 7/015 270/21.1 |
| 8,480,069 | B2 * | 7/2013 | Shibasaki | B31F 1/0012 270/37 |
| 2008/0006993 | A1 * | 1/2008 | Nomura | B65H 29/58 271/240 |
| 2008/0122156 | A1 | 5/2008 | Fujii et al. | |
| 2011/0064541 | A1 * | 3/2011 | Kikkawa | B65H 45/18 412/13 |
| 2012/0083400 | A1 | 4/2012 | Shibasaki et al. | |

FOREIGN PATENT DOCUMENTS

| | | | |
|---|---|---|---|
| JP | 2007156406 | A | 6/2007 |
| JP | 2008013274 | A | 1/2008 |
| JP | 2008051890 | A | 3/2008 |
| JP | 2012051685 | A | 3/2012 |
| JP | 2012076883 | A | 4/2012 |
| JP | 2012086909 | A | 5/2012 |

OTHER PUBLICATIONS

Chinese Office Action (and English translation thereof) dated Dec. 11, 2015, issued in counterpart Chinese Application No. 201410269737.3.

* cited by examiner

SHEET PROCESSING APPARATUS HAVING FIRST AND SECOND ALIGNERS CONTROLLED BASED ON COMBINATION OF PREDETERMINED JOB PARAMETERS, AND IMAGE FORMING SYSTEM HAVING SHEET PROCESS APPARATUS

BACKGROUND OF THE INVENTION

1. Field of the Invention

The present invention relates to a sheet processing apparatus and an image forming system.

2. Description of Related Art

There are known some conventional image forming apparatuses such as copiers, each of which includes a lateral alignment unit including a pair of alignment members for correction (alignment) by pushing a sheet inward at its lateral edges across the width orthogonal to the moving direction of the sheet, to correct the deviation (inclination) of the sheet from its moving direction.

Since the alignment members of the lateral alignment unit push both the lateral edges inward across the width of the sheet, a sheet having low stiffness (rigidity) (e.g., thin paper) is deformed and cannot be readily aligned.

To correct the deviation from the moving direction of the sheet for its alignment, there are also known some apparatuses each of which includes a register alignment unit including register rollers for receiving the front edge of the conveyed sheet abutting the rollers for a predetermined period of time to warp the sheet.

Unfortunately, the register alignment unit cannot sufficiently warp a conveyed sheet having high stiffness or rigidity (e.g., thick paper), and cannot readily correct the deviation.

These two types of apparatuses cannot sufficiently correct the deviation of sheets from the moving direction, if the sheets are unsuitable for the apparatus. This trouble may adversely affect the subsequent process.

Against these problems, for example, an apparatus disclosed in Japanese Patent Application Laid Open Publication No. 2008-51890 determines the rigidity of a still sheet lying at a waiting position before the start of register alignment and controls the driving of register rollers and sheet feeding rollers for feeding the sheet to the register rollers, to certainly warp various types of sheets having different thicknesses.

Unfortunately, in the apparatus disclosed in Japanese Patent Application Laid Open Publication No. 2008-51890, a sheet having high rigidity, which is forcibly pressed against the register rollers for its warpage, may be squeezed between the register rollers and may not sufficiently warp.

More specifically, the apparatus disclosed in Japanese Patent Application Laid Open Publication No. 2008-51890 cannot appropriately correct the deviation from the moving direction caused by physical parameters, such as the thicknesses and the rigidity, of some sheets, and cannot stably convey the sheets to the subsequent processes.

SUMMARY OF THE INVENTION

The present invention has been made in consideration of the above problems in conventional techniques, and an object of the present invention is to provide a sheet processing apparatus and an image forming system which can appropriately correct the deviation from the moving direction of the sheet and stably convey the sheet to the subsequent processes.

In order to achieve the above object, according to one aspect of the present invention, there is provided a sheet processing apparatus including: a first aligner to push lateral edges of a sheet inward across a width direction of the sheet conveyed from an upstream side for alignment of the sheet, the width direction being orthogonal to a moving direction of the sheet; a second aligner to abut a front edge of the sheet conveyed from the upstream side for a predetermined period of time for alignment of the sheet; a first aligner driver to drive the first aligner; a second aligner driver to drive the second aligner; and a controller to control operations of the first aligner driver and the second aligner driver, wherein the controller activates or inactivates the first aligner driver and the second aligner driver depending on a predetermined parameter on the conveyed sheet.

Preferably, in the sheet processing apparatus, the controller determines whether a basis weight of the conveyed sheet is higher than a predetermined weight on the basis of the predetermined parameter, if the basis weight of the sheet is higher than the predetermined weight, the controller activates the first aligner driver alone, and if the basis weight of the sheet is not higher than the predetermined weight, the controller activates both the first aligner driver and the second aligner driver.

Preferably, the sheet processing apparatus further includes a collector to collect one or more sheets conveyed from the upstream side, wherein the first aligner aligns the sheets collected in the collector, the second aligner aligns the sheets discharged from the collector, the controller determines whether a single sheet is to be collected in the collector on the basis of the predetermined parameter, if a single sheet is to be collected in the collector, the controller determines whether the basis weight of the conveyed sheet is higher than the predetermined weight, and if two or more sheets are to be collected in the collector, the controller activates the first aligner driver alone.

Preferably, in the sheet processing apparatus, if a single sheet is to be collected in the collector and if the basis weight of the sheet is not higher than the predetermined weight, the controller determines whether any subsequent process requires centering of the sheet in the width direction on the basis of the predetermined parameter, and if any subsequent process requires the centering of the sheet in the width direction, the controller activates both the first aligner driver and the second aligner driver, and if no subsequent process requires the centering of the sheet in the width direction, the controller activates the second aligner driver alone.

Preferably, in the sheet processing apparatus, if a single sheet is to be collected in the collector and if the basis weight of the sheet is higher than the predetermined weight, the controller determines whether any subsequent process requires centering of the sheet in the width direction on the basis of the predetermined parameter, and if any subsequent process requires the centering of the sheet in the width direction, the controller activates the first aligner driver, and if no subsequent process requires the centering of the sheet in the width direction, the controller does not activate the first aligner driver.

Preferably, in the sheet processing apparatus, a sheet conveying path between the first aligner and the second aligner includes a curved conveying path.

Preferably, in the sheet processing apparatus, the first aligner includes a pair of alignment members reciprocatable in the width direction to align the lateral edges across the width direction of the sheet, and the controller controls a distance between the alignment members according to a width of the sheet during charge and/or discharge of the sheet into and/or from a collector.

Preferably, in the sheet processing apparatus, a collector includes a creaser to score the sheet which is aligned with the first aligner.

Preferably, the sheet processing apparatus further includes a trimmer downstream of the second aligner in the moving direction of the sheet, the trimmer trimming off margins along the lateral edges across the width direction of the conveyed sheet.

According to another aspect of the present invention, there is provided an image forming system including: an image forming unit to form an image on a sheet; and the sheet processing apparatus according to claim 1 to perform a predetermined process on the sheet having the image formed by the image forming unit.

BRIEF DESCRIPTION OF THE DRAWINGS

The above and other objects, advantages and features of the present invention will become more fully understood from the detailed description given hereinbelow and the appended drawings which are given byway of illustration only, and thus are not intended as a definition of the limits of the present invention, and wherein.

DETAILED DESCRIPTION OF THE PREFERRED EMBODIMENT

An image forming system 1 according to an embodiment of the invention will now be described with reference to the drawings.

Figure 1:
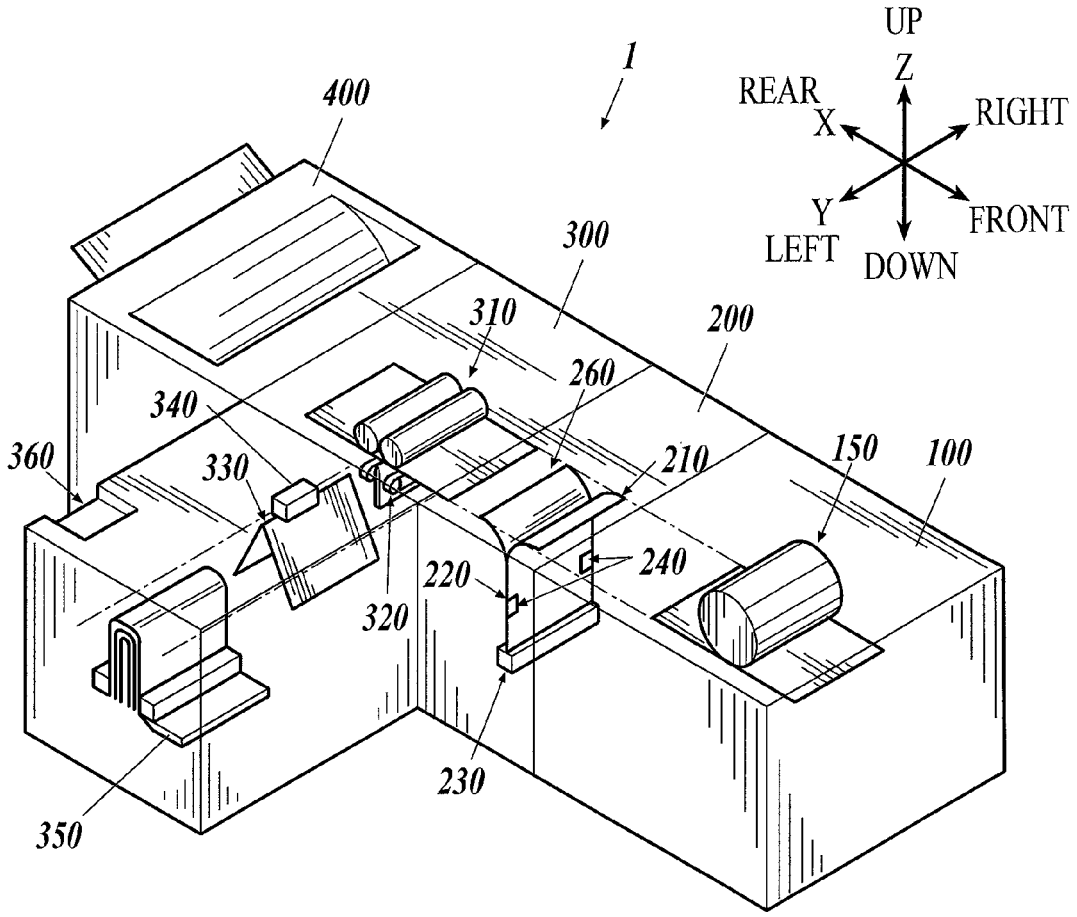
FIG. 1 is a schematic diagram illustrating the entire configuration of an image forming system.

FIG. 1 is a schematic diagram illustrating the entire configuration of the image forming system 1.

The image forming system 1 includes an image forming unit 100, an intermediate conveying unit (sheet processing apparatus) 200, a saddle stitching unit 300, and a side stitching unit 400.

In the following description, the vertical direction is referred to as "Z direction"; the direction of an array of the image forming unit 100, the intermediate conveying unit 200, the saddle stitching unit 300, and the side stitching unit 400 in FIG. 1 is referred to as "X direction"; and the direction orthogonal to both the X and Z directions is referred to as "Y direction."

Sheets are conveyed in the image forming system 1 from the front to the rear in the X direction.

The image forming unit 100 forms an image on a sheet.

In specific, the image forming unit 100 for forming an image on a sheet includes, for example, a conveyer to extract and convey one sheet from the sheets stored as recording media from a sheet tray, a developer to develop a toner image based on bitmap data on a first transfer member such as transfer roller, a first transfer mechanism to transfer the toner image on the first transfer member to a second transfer member such as transfer drum 150, a second transfer mechanism to transfer the toner image on the second transfer member to the sheet conveyed by the conveyer, a fixer to fix the transferred toner image onto the sheet, and an ejector to eject the sheet after the fixation by the fixer.

The image forming unit 100 transports the ejected sheet having the image to the intermediate conveying unit 200. That is, the connection in the image forming system 1 allows the sheet to be transported from the image forming unit 100 to the intermediate conveying unit 200.

The intermediate conveying unit 200 can temporarily stack a sheet or a predetermined number of sheets and then transport the sheet(s) to the saddle stitching unit 300.

Figure 2:
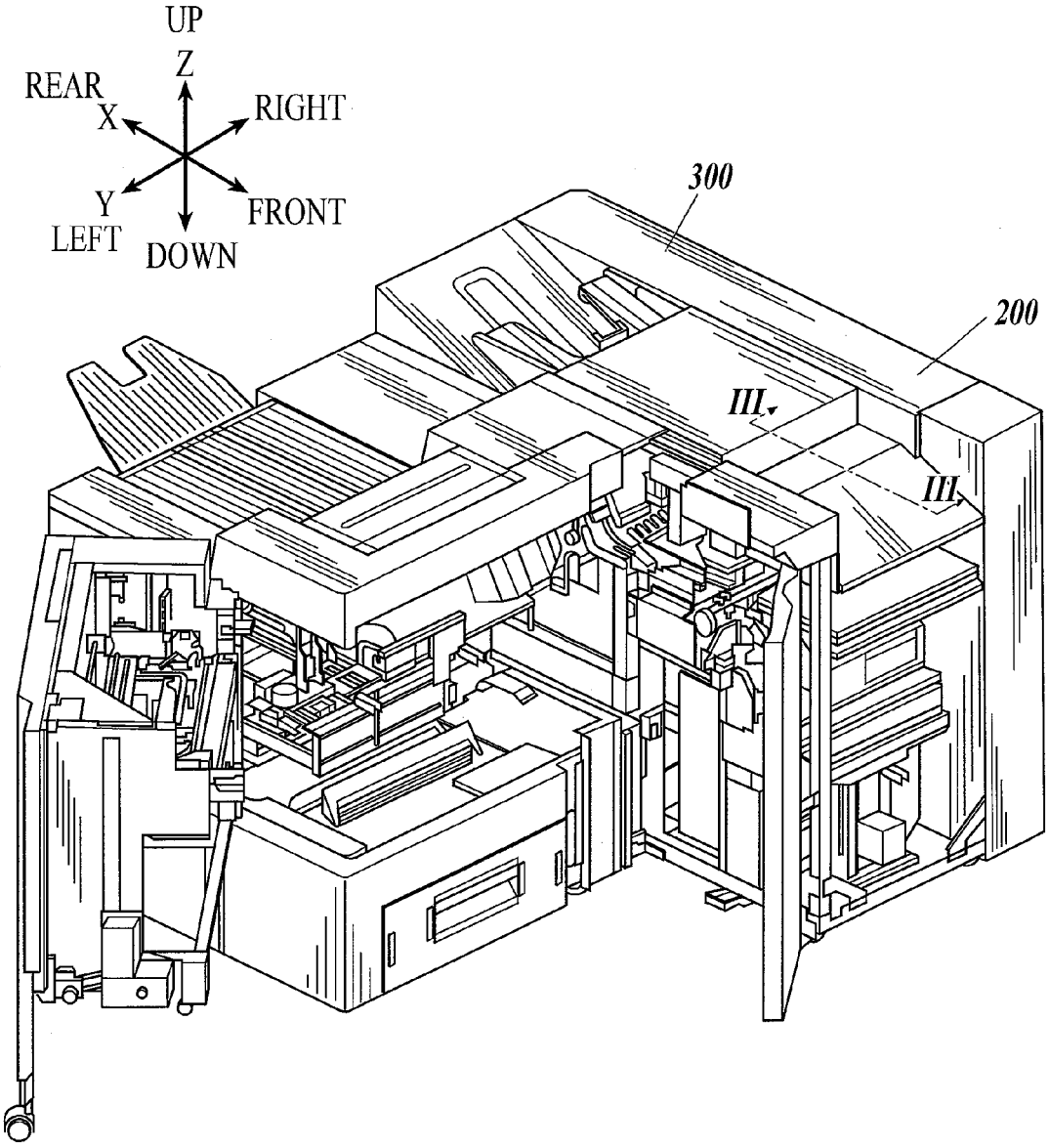
FIG. 2 is a perspective view illustrating the appearance of an intermediate conveying unit and a saddle stitching unit.
Figure 3:
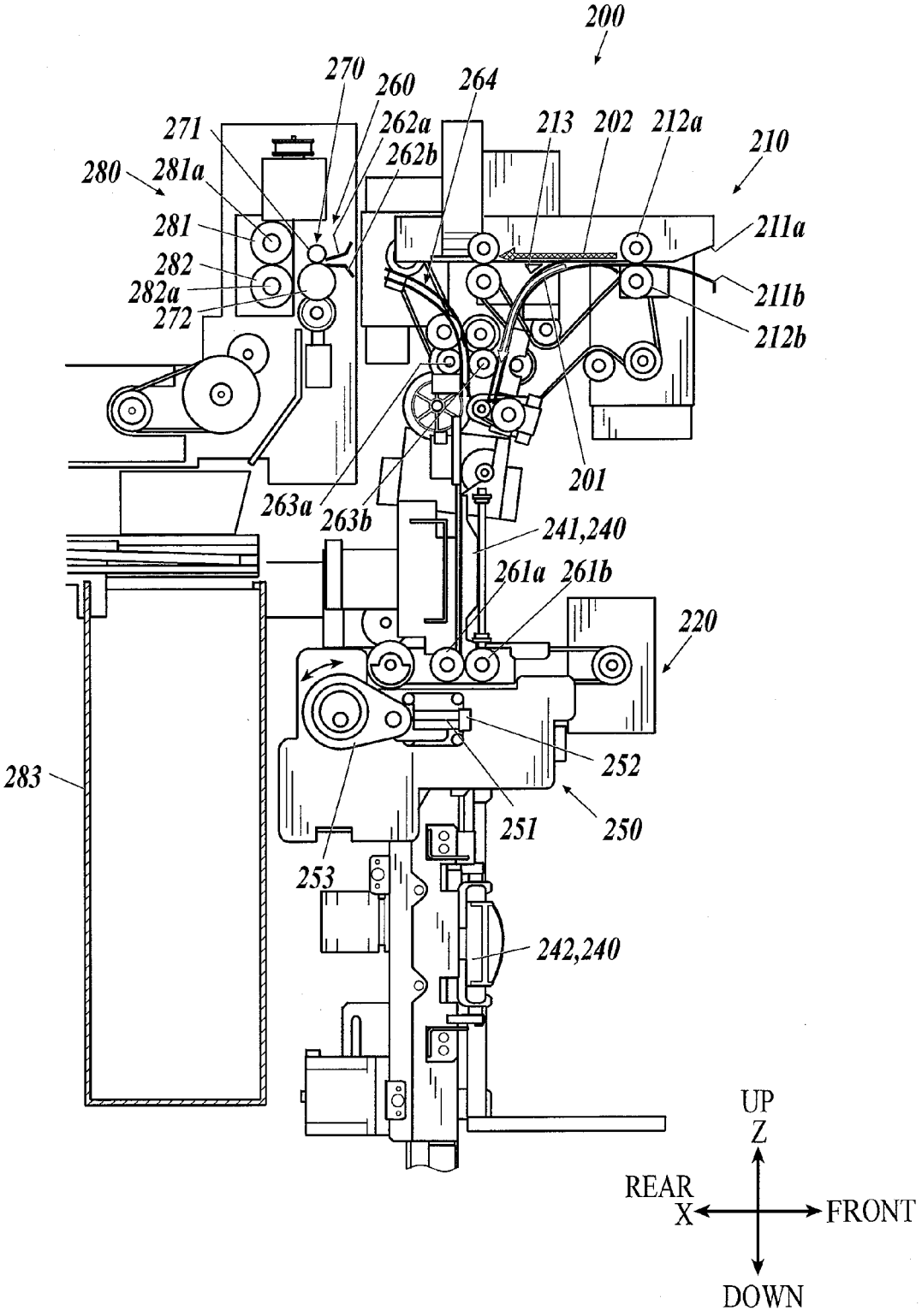
FIG. 3 is a cross-sectional view, along the line in FIG. 2, illustrating an example main configuration inside the intermediate conveying unit.

FIG. 2 is a perspective view illustrating the appearance of the intermediate conveying unit 200 and the saddle stitching unit 300. FIG. 3 is a cross-sectional view, along the line III-III in FIG. 2, illustrating an example main configuration inside the intermediate conveying unit 200.

The intermediate conveying unit 200 includes an receiver 210 to receive sheets one by one from the image forming unit 100; a collector (stacker) 220 to collect a predetermined number (one or larger) of sheets introduced from the receiver 210; a longitudinal aligner 230 to align the front and rear edges in the moving direction of the sheets in the collector 220; a lateral aligner (first aligner) 240 to align the lateral edges across the width orthogonal to the moving direction of the sheets aligned with the longitudinal aligner 230; a creaser 250 to score the sheets in the collector 220; a sheet discharger 260 to discharge the sheets from the collector 220; a register aligner (second aligner) 270 to receive the abutting front edges of the sheets discharged from the sheet discharger 260 to correct the inclination of the sheets; and a slitter (trimmer) 280 to trim off margins along the lateral edges across the width of the sheets.

The receiver 210 includes a pair of upper and lower receiving plates 211*a* and 211*b* to receive a sheet from the image forming unit 100, a pair of conveyor rollers 212*a* and 212*b* to nip the sheet therebetween and convey the sheet, and a switching gate 213 to switch the path of the sheet conveyed with the conveyor rollers 212*a* and 212*b* between a first conveying path 201 and a second conveying path 202.

The first conveying path 201 guides the sheet downward, while the second conveying path 202 guides the sheet in the horizontal direction. The first conveying path 201 and the second conveying path 202 each have a width in the Y direction not smaller than the maximum width in the Y direction of sheets to be conveyed, to guide all the sheets having various sizes processed in the image forming system 1.

The sheet ejected from the image forming unit 100 is introduced into the intermediate conveying unit 200 via the receiving plates 211*a* and 211*b*, is nipped between the conveyor rollers 212*a* and 212*b* driven by a driver (not shown), and is conveyed through the first conveying path 201 or the second conveying path 202 determined by the switching gate 213.

If the path of the sheet is switched to the first conveying path 201, the sheet is guided downward along the first conveying path 201. The sheet conveyed through the first conveying path 201 reaches a position where the conveyor rollers 212*a* and 212*b* release the rear edge in the moving direction of the sheet, and then falls freely toward the bottom of the first conveying path 201. The sheet falls through the first conveying path 201 to the longitudinal aligner 230 at the bottom of the first conveying path 201, so that the lower edge of the sheet is supported by a stopper 231 (refer to FIGS. 4 and 5) of the longitudinal aligner 230.

The collector 220 is a space defined at a part of the first conveying path 201 extending downward from the receiver 210, and accommodates a predetermined number of sheets. The longitudinal aligner 230 and the lateral aligner 240 are disposed inside the collector 220.

The number of sheets to be collected is preset as one of the predetermined parameters on sheets.

Figure 4:
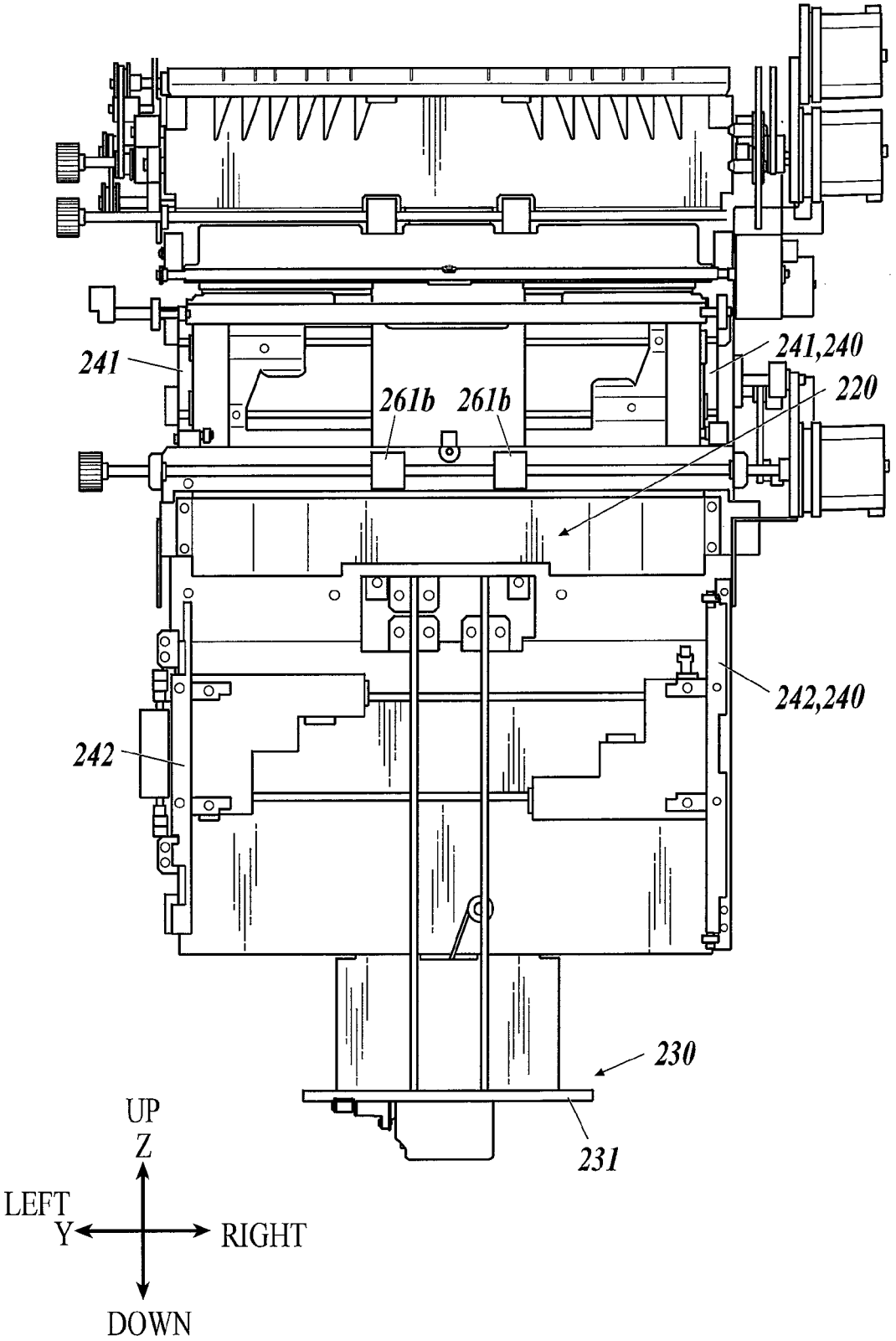
FIG. 4 is a plan view illustrating an example lateral aligner and an example register aligner.
Figure 5:
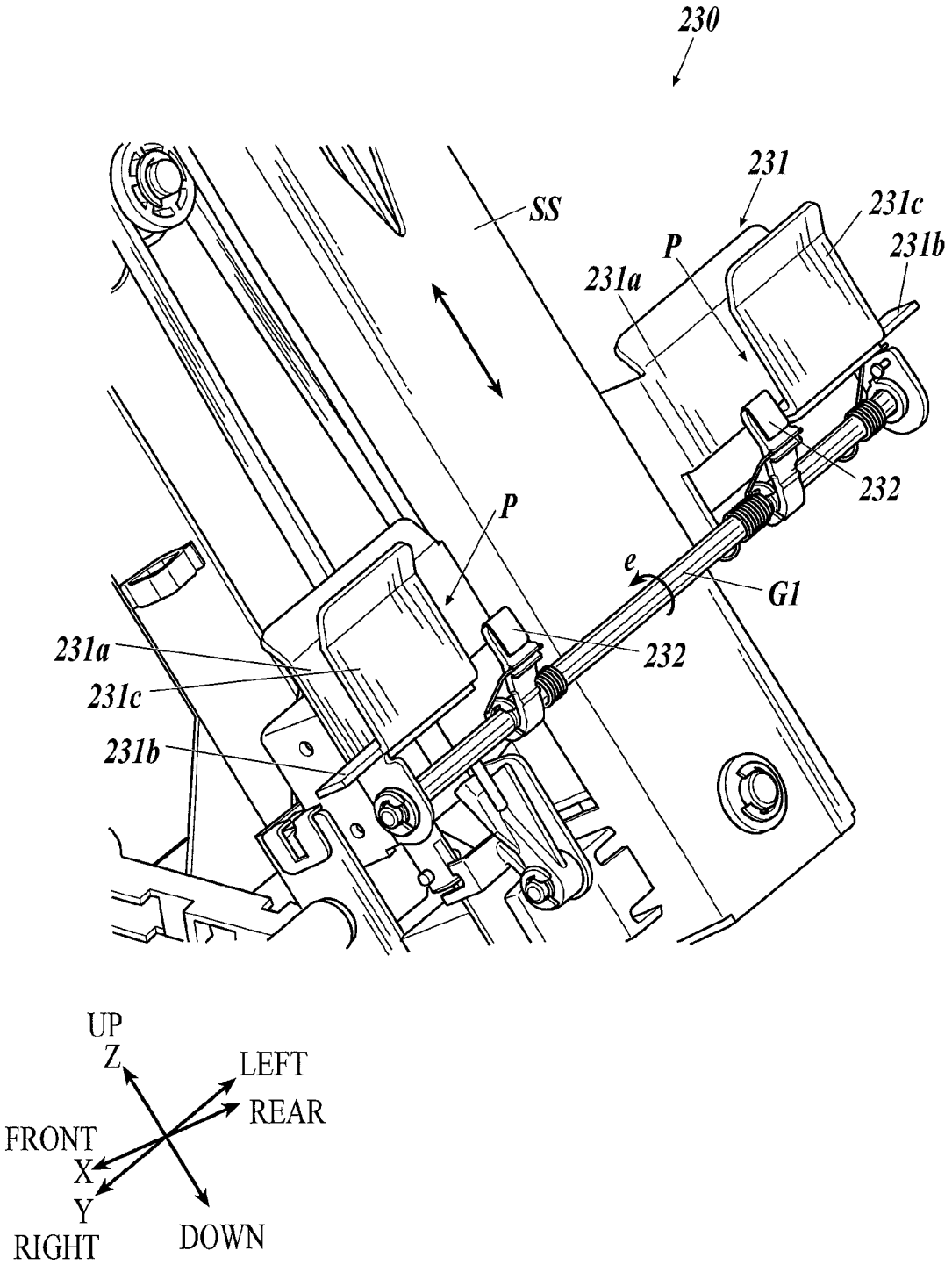
FIG. 5 is a perspective view illustrating an example main configuration of a longitudinal aligner.

FIG. 4 is a plan view illustrating an example of the collector 220, the longitudinal aligner 230, and the lateral aligner 240. FIG. 5 is a perspective view illustrating an example main configuration of the longitudinal aligner 230.

The longitudinal aligner 230 for longitudinal alignment supports the lower edges of the sheets fallen through the first conveying path 201 and aligns the lower edges.

In specific, the longitudinal aligner 230 includes the stopper 231, which is slidable in the Z direction along a vertically long stopper support SS, as illustrated in FIG. 5. The bottom of the stopper support SS is downstream of the moving direction of sheets, while the top of the stopper support SS is upstream.

The sliding distance of the stopper 231 in the vertical direction is determined depending on the size of the sheets.

The stopper support SS stands on the bottom of the first conveying path 201 at the center in the Y direction between lower alignment plates 242 and 242 (described below) of the lateral aligner 240.

The stopper 231 consists of two components on both sides of the stopper support SS, each having a first sidewall 231*a* having a surface substantially parallel to the surface of the sheets, a bottom 231*b* protruding backward from the lower end of the first sidewall 231*a* substantially perpendicularly to the surface of the sheets, and a second sidewall 231*c* extending upward from the rear end of the bottom 231*b* and having a surface substantially parallel to the first sidewall 231*a*.

The second sidewall 231*c* has a smaller dimension in the Y direction than that of the first sidewall 231*a*. The inner portions of the first sidewalls 231*a* near the stopper support SS are opposed to two grippers 232 and 232 (described below).

The stopper 231 receives the sheets fallen through the first conveying path 201 in a space P defined by the first sidewalls 231*a*, the bottoms 231*b*, and the second sidewalls 231*c*, such that the front edges in the moving direction (the lower edges) of the sheets hit against the bottoms 231*b* and stop. That is, the stopper 231 aligns the lower edges of the sheets and supports them. The alignment of the lower edges of the sheets with the stopper 231 leads to the alignment of their upper edges.

The stopper 231 includes the grippers 232 and 232 to pinch the sheets near the widthwise center, which are supported by the stopper 231, as illustrated in FIG. 5.

The grippers 232 and 232 can rotate in the direction of the arrow (e) in FIG. 5 or its opposite direction around a rotation shaft G1 extending in the Y direction orthogonal to the moving direction of the sheets and parallel with the surface of the sheets.

In specific, while the sheets are being supported by the stopper 231, the rotation shaft G1 rotates forward under the control of an intermediate conveyance controller 504 (refer to FIG. 6), so that the grippers 232 and 232 rotate in the direction of the arrow (e) in FIG. 5 and come into contact with the sheets to pinch them in cooperation with the first sidewalls 231*a*.

The sheet is pinched with the grippers 232 and 232 after the alignment of the sheets in the width direction with the lateral aligner 240 (described below), if such an alignment is performed.

If the rotation shaft G1 rotates backward under the control of the intermediate conveyance controller 504, the grippers 232 and 232 rotate in the direction opposite to the arrow (e) in FIG. 5. The grippers 232 and 232 then are detached from the sheets and release them.

The sheets are released from the grippers 232 and 232 after the nip of the sheets by a pair of conveyor rollers 261*a* and 261*b* (described below).

The lateral aligner 240 pushes the lateral edges inward across the width (Y direction) of the sheets orthogonal to the moving direction, for alignment in the width direction of the sheets after the longitudinal alignment with the longitudinal aligner 230.

In specific, the lateral aligner 240 includes upper alignment plates 241 and 241 (a pair of alignment members) disposed on both upper sides of the sheets fallen through the first conveying path 201; the lower alignment plates 242 and 242 (a pair of alignment members) disposed on both lower sides of the sheets; and a driver (first aligner driver) 243 (refer to FIG. 6) to drive the upper alignment plates 241 and 241 and the lower alignment plates 242 and 242.

The upper alignment plates 241 and 241 and the lower alignment plates 242 and 242 are reciprocated by the driver 243 to come closer to or get away from each other in the Y direction.

The sheets fallen through the first conveying path 201 and supported at their lower edges by the stopper 231 of the longitudinal aligner 230, are aligned in the lateral direction (width direction) with the upper alignment plates 241 and 241 coming into contact with the upper lateral edges across the width of the sheets and the lower alignment plates 242 and 242 coming into contact with the lower lateral edges across the width of the sheets.

This configuration can achieve centering of a sheet to match the widthwise center of the sheet with the widthwise center of the conveying path. For multiple sheets, the configuration can align the lateral edges across the width of the sheets.

The lateral aligner 240 is controlled such that the distance between the upper alignment plates 241 and 241 and the distance between the lower alignment plates 242 and 242 are each slightly smaller than the normal width of the sheets, to process sheets having differences in width. The upper alignment plates 241 and 241 and the lower alignment plates 242 and 242 push the lateral edges across the width of the sheets for accurate lateral alignment.

During the charge and discharge of the sheets into and from the collector 220, the distance between the upper alignment plates 241 and 241 and the distance between the lower alignment plates 242 and 242 are each equal to or slightly larger than the normal width of the sheets. The upper alignment plates 241 and 241 and the lower alignment plates 242 and 242 therefore guide the sheets during the charge and discharge of the sheets into and from the collector 220, to prevent irregular movements of the sheets.

In this embodiment, the upper alignment plates 241 and 241 and the lower alignment plates 242 and 242 guide the sheets during the charge and discharge of the sheets into and from the collector 220, as described above. Alternatively, the alignment plates may guide the sheets during only either one of these processes, or may guide the sheets during neither of the processes.

After the longitudinal alignment of the sheets with the longitudinal aligner 230, the driver 243 drives the upper alignment plates 241 and 241 and the lower alignment plates 242 and 242 to symmetrically slide in the Y direction for the above-explained lateral alignment, under the control of the intermediate conveyance controller 504.

In the embodiment, the lateral alignment is activated or inactivated depending on the predetermined parameters on sheets to be collected in the collector 220.

The predetermined parameters on sheets are preset by a user for each job. Examples of the predetermined parameters on sheets include type, basis weight, the number to be collected, and process mode (e.g., saddle stitching, folding, and side stitching).

The lateral alignment is adopted, for example, if a single sheet is collected in the collector 220 and if any subsequent process requires centering of the sheet.

The lateral alignment is also adopted if two or more sheets are collected in the collector 220.

The intermediate conveying unit 200 according to the embodiment can appropriately correct the deviation of the sheets during the conveyance with a proper combination of the lateral alignment and register alignment (explained below) depending on the predetermined parameters on each group of sheets to be collected in the collector 220.

The creaser 250 includes a scoring knife 251, a pad 252, and a cam 253.

The scoring knife 251 moves forward in FIG. 3 against the pad 252 in response to the rotation of the cam 253, under the control of the intermediate conveyance controller 504. The pad 252 receives the scoring knife 251.

The stopper 231 of the longitudinal aligner 230 ascends or descends so that the scoring knife 251 faces the position to be scored on the sheets. The scoring knife 251 then moves forward and presses the sheets against the pad 252 to score the sheets.

The sheet discharger 260 discharges the sheets from the collector 220 in synchronization with the timing of termination of various processes (e.g., saddle stitching, folding, side stitching, and trimming) on the preceding sheets.

The sheet discharger 260 includes the conveyor rollers 261*a* and 261*b*, a pair of upper and lower guide plates 262*a* and 262*b*, and rollers 263*a* and 263*b*.

With reference to FIG. 3, the conveyor rollers 261*a* and 261*b* face each other at a substantially center in the Z direction of the first conveying path 201 and are separated by the sheets collected in the collector 220.

During the charge of the sheets through the first conveying path 201, the conveyor rollers 261*a* and 261*b* are apart from each other not to block the sheets.

During the discharge of the sheets through the first conveying path 201, the conveyor rollers 261*a* and 261*b* are rotated by a driver M1 (refer to FIG. 6) while abutting each other and convey the sheets toward the guide plates 262*a* and 262*b*.

In specific, after the grippers 232 and 232 pinch the sheets, the conveyor rollers 261*a* and 261*b* nip the pinched sheet. After the grippers 232 and 232 release the sheets, the conveyor rollers 261*a* and 261*b* start conveying the sheets. The sheets are then conveyed with the rollers 263*a* and 263*b* through a curved conveying path 264 to the upper and lower guide plates 262*a* and 262*b*.

The guide plate 262*a* is disposed above the path of sheets and is elongated in the Y direction. The guide plate 262*b* is disposed below the guide plate 262*a* with a predetermined gap from the guide plate 262*a* and is elongated in the Y direction.

The sheet conveyed with the rollers 263*a* and 263*b* enters a gap between the guide plates 262*a* and 262*b* and is held therebetween, to be conveyed to the subsequent process while maintaining its aligned state.

Figure 6:
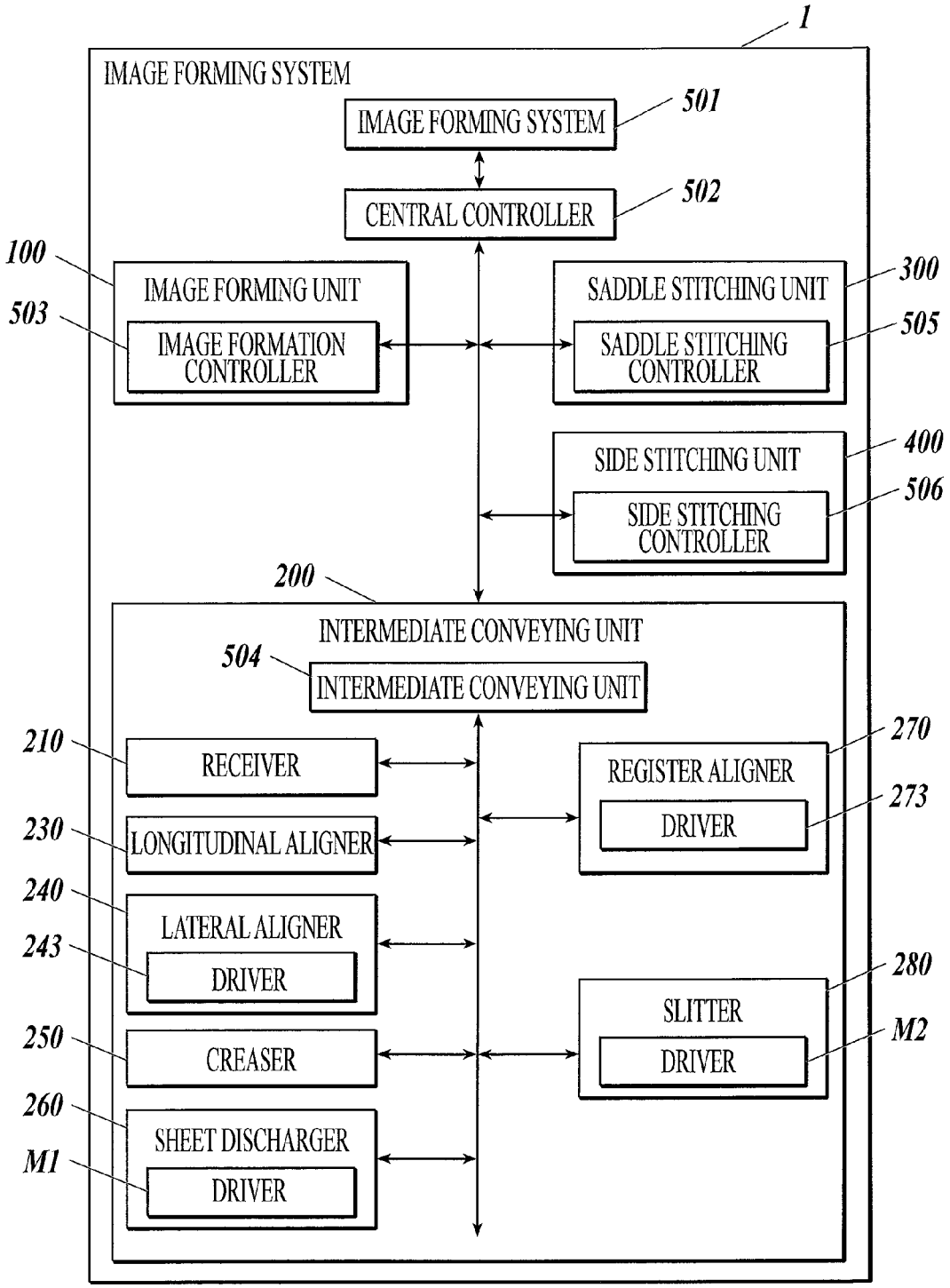
FIG. 6 is a block diagram illustrating the main configuration for controlling operations of an image forming system.

The register aligner 270 includes a pair of register rollers 271 and 272 and a driver (second aligner driver) 273 (refer to FIG. 6).

The register rollers 271 and 272 are disposed downstream of the guide plates 262*a* and 262*b* in the moving direction of the sheet.

The register rollers 271 and 272 are rotated by the driver 273 in the direction opposite to the moving direction of the sheet for a predetermined period, and receive and abut with the front edge of the sheet discharged from the collector 220, for the register alignment to correct the inclination of the sheet.

For the register alignment, the register rollers 271 and 272 are rotated by the driver 273 in the direction opposite to the moving direction of the sheet for the predetermined period while the front edge of the conveyed sheet is in contact with the register rollers 271 and 272. The reverse rotation of the register rollers 271 and 272 causes warpage of the sheet during the predetermined period.

After the reverse rotation for the predetermined period, the register rollers 271 and 272 are rotated by the driver 273 forward in the moving direction of the sheet.

This operation can correct the inclination of the sheet if such inclination has been caused during the conveyance, and can convey the sheet to the subsequent process without inclination from the moving direction.

In response to the arrival of the sheet conveyed with the conveyor rollers 261*a* and 261*b*, the driver 273 rotates the register rollers 271 and 272 for the register alignment, under the control of the intermediate conveyance controller 504.

In the embodiment, the register alignment is activated or inactivated depending on the predetermined parameters on sheets to be collected in the collector 220.

The predetermined parameters on sheets are preset by a user for each job. Examples of the predetermined parameters on sheets include type, basis weight, the number to be collected, and process mode (e.g., saddle stitching, folding, and side stitching).

In specific, the register alignment is adopted if a single sheet is to be collected in the collector 220 and if the basis weight of the sheet is not higher than a predetermined weight (216 g/m$^2$, for example).

The intermediate conveying unit 200 according to the embodiment can appropriately correct the deviation of sheets during the conveyance with a proper combination of the register alignment and the lateral alignment depending on the predetermined parameters on each group of sheets to be collected in the collector 220.

The slitter 280 is disposed downstream of the register rollers 271 and 272 in the moving direction of the sheets. The slitter 280 includes two pairs of slitter blades 281 and 282 to trim off margins along the lateral edges across the width of the sheets conveyed by the forward rotation of the register rollers 271 and 272, and a dust bin 283 to accommodate the trimmed-off margins.

Each pair of slitter blades 281 and 282 are discoidal blades parallel with the XZ plane. The slitter blades 281 and 282 are adjacently disposed above and below the path of the sheets conveyed through the slitter 280.

The slitter blades 281 and 282 are rotated by a driver M2 (refer to FIG. 6) around rotation shafts 281*a* and 282*a*, respectively, at an identical speed in opposite directions, to engage with each other in the X direction.

In specific, the adjacent slitter blades 281 and 282 are slightly displaced from each other in the Y direction to cut the sheets therebetween.

The two pairs of slitter blades 281 and 282 are disposed on the respective sides of the path of the sheets (sides across the Y direction), and operate in synchronization with each other.

The slitter blades 281 and 282 are each slidable in the Y direction, so that the distance between the pairs of slitter blades 281 and 282 is variable depending on the width of conveyed sheets.

The sheets after trimming of the margins with the slitter blades 281 and 282 are transported to the saddle stitching unit 300. The trimmed-off margins drop into the dust bin 283 disposed below the slitter blades 281 and 282.

The dust bin 283 is disposed below the slitter blades 281 and 282 and has an open top, to accommodate the margins trimmed off with the slitter blades 281 and 282. The dust bin 283 can be extracted from the intermediate conveying unit 200 by a user at any timing for disposal of the content of the dust bin 283.

Referring back to FIG. 1, the saddle stitching unit 300 folds sheets in half at the center, staples the predetermined number of stacked half-folded sheets to prepare a saddle stitched booklet, and trims the end surfaces of the saddle stitched booklet.

In specific, the saddle stitching unit 300 includes a half folder 310 to fold the sheets received from the intermediate conveying unit 200 in half along the Y direction, a discharge mechanism 320 to discharge the half folded sheets in the Y direction, a sheet collector 330 to collect the sheets discharged by the discharge mechanism 320, a saddle stitcher 340 to staple the predetermined number of sheets collected in the sheet collector 330 along the fold line for preparation of a saddle stitched booklet, a cutter 350 to trim the end surfaces of the saddle stitched booklet, and a discharger 360 to discharge the saddle stitched booklet having the trimmed end surfaces.

The saddle stitching unit 300 may transport the sheets received from the intermediate conveying unit 200 to the side stitching unit 400, without performing a part or all of the various processes on the sheets. The saddle stitching unit 300 may further include a processor to fold the sheets into a square shape to form the spine of the saddle stitched booklet.

The side stitching unit 400 provides side stitching on multiple sheets.

In specific, the side stitching unit 400 includes, for example, a stapler to staple the sheets received from the saddle stitching unit 300, a page end cutter to trim off apart of the end surface parallel to the spine of the stapled sheets, and a discharger to discharge the sheets processed through all the connected units.

The side stitching unit 400 may discharge the sheets received from the saddle stitching unit 300, without performing a part or all of the various processes on the sheets.

The control over operations of the image forming system 1 will now be described.

FIG. 6 is a block diagram illustrating the main configuration for controlling operations of the image forming system 1.

The image forming system 1 includes an operation display 501 to receive an input for an operation of the image forming system 1 from a user and provide a display for the operation; a central controller 502 intensively controls operations of the image forming system 1; an image formation controller 503 to control operations of the image forming unit 100; the intermediate conveyance controller (controller) 504 to control operations of the intermediate conveying unit 200; a saddle stitching controller 505 to control operations of the saddle stitching unit 300; and a side stitching controller 506 to control operations of the side stitching unit 400.

The operation display 501 includes, for example, a touch-panel input device, or switches and/or keys for various inputs. The operation display 501 transmits signals in response to the input from the user, to the central controller 502.

The central controller 502, the image formation controller 503, the intermediate conveyance controller 504, the saddle stitching controller 505, and the side stitching controller 506 each include a CPU, a RAM, and a ROM, to read and execute software programs and various data depending on the processes.

The central controller 502 determines various parameters on the image forming system 1 in response to the input from the user through the operation display 501. The central controller 502 then outputs instructions for the processes depending on the determined parameters to the image formation controller 503, the intermediate conveyance controller 504, the saddle stitching controller 505, and the side stitching controller 506. The slave controllers control operations of their respective target units in accordance with the instructions.

The determination of alignment modes of the lateral aligner 240 and the register aligner 270 under the control of the intermediate conveyance controller 504 will now be explained.

Figure 7:
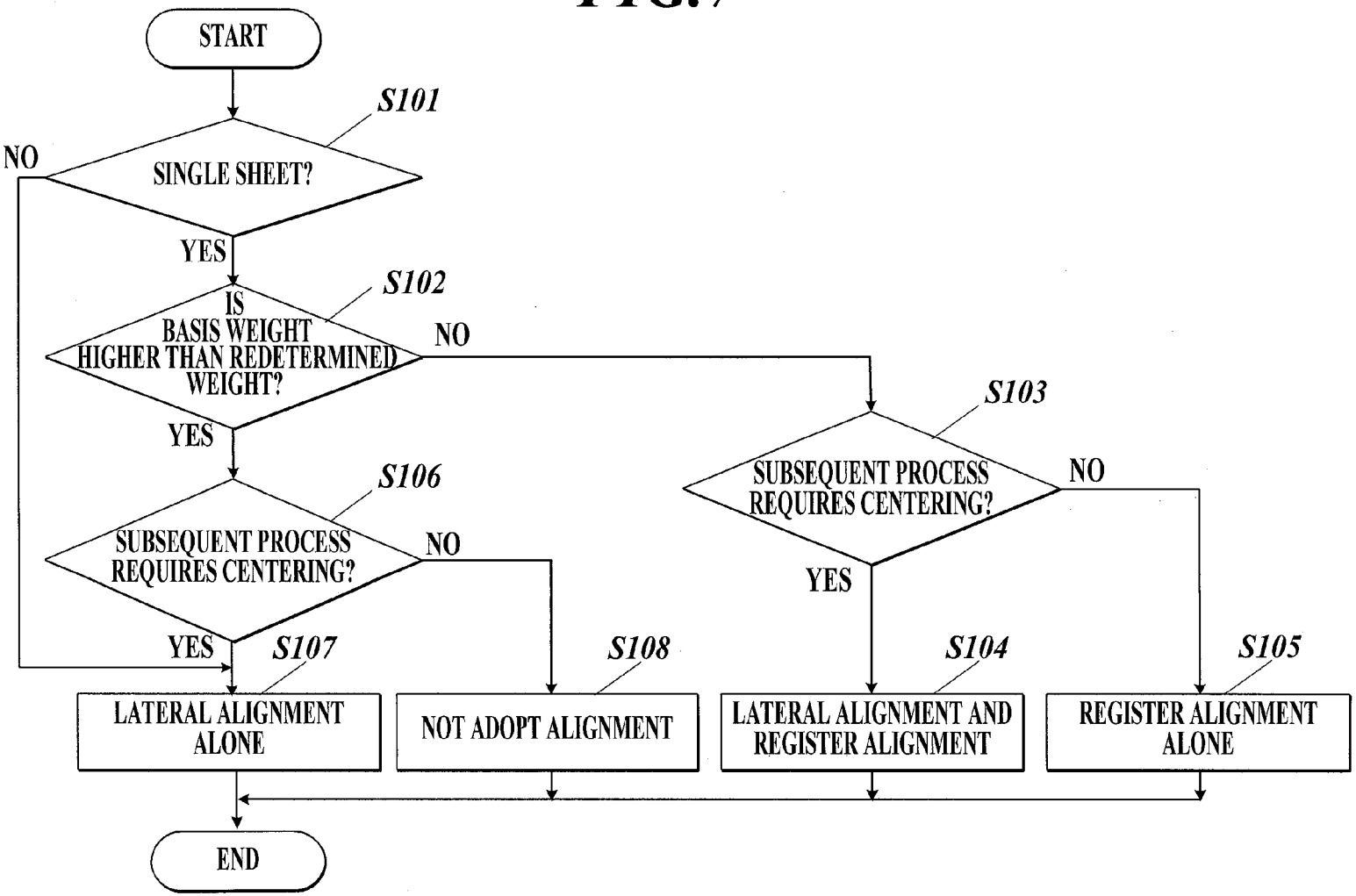
FIG. 7 is a flowchart illustrating an alignment mode determining process in an intermediate conveying unit.

FIG. 7 is a flowchart illustrating the process of determining alignment modes of the lateral aligner 240 and the register aligner 270.

Before the determining process, the user manipulates the operation display 501 to set several parameters on the operations of the intermediate conveying unit 200.

These parameters include the predetermined parameters on sheets to enter the intermediate conveying unit 200. Examples of the predetermined parameters on sheets include type, basis weight, the number to be collected, and process mode (e.g., saddle stitching, folding, and side stitching).

Examples of the parameters regarding a processing mode include activation/inactivation of trimming of margins along the edges in the moving direction of the sheets, and the width of the margins to be trimmed off.

The parameters also include a predetermined threshold basis weight of a sheet to determine alignment modes of the lateral aligner 240 and the register aligner 270. The threshold weight is set to be 216 g/m$^2$, for example, and can be appropriately varied by the user through manipulation of the operation display 501.

In Step S101, the intermediate conveyance controller 504 determines whether a single sheet is to be collected in the collector 220. If two or more sheets are to be collected (Step S101: No), the process goes to Step S107.

If a single sheet is to be collected (Step S101: Yes), the process goes to Step S102, and the intermediate conveyance controller 504 determines whether the basis weight of the sheet to be collected is higher than the predetermined weight (216 g/m$^2$ in this example).

If the basis weight of the sheet is not higher than the predetermined weight (Step S102: No), the process goes to Step S103, and the intermediate conveyance controller 504 determines whether any subsequent process requires centering of the sheet in the width direction.

If any subsequent process requires the centering (Step S103: Yes), the process goes to Step S104. In Step S104, the intermediate conveyance controller 504 adopts both the lateral alignment with the lateral aligner 240 and the register alignment with the register aligner 270, and then terminates the process.

If no subsequent process requires the centering (Step S103: No), the process goes to Step S105. In Step S105, the intermediate conveyance controller 504 adopts the register alignment with the register aligner 270 alone, and then terminates the process.

If the basis weight of the collected sheet is higher than the predetermined weight (Step S102: Yes), the process goes to Step S106, and the intermediate conveyance controller 504 determines whether any subsequent process requires centering of the sheet in the width direction.

If any subsequent process requires the centering (Step S106: Yes), the process goes to Step S107. In Step S107, the intermediate conveyance controller 504 adopts the lateral alignment with the lateral aligner 240 alone, and then terminates the process.

If no subsequent process requires the centering (Step S106: No), the process goes to Step S108. In Step S108, the intermediate conveyance controller 504 does not adopt the alignment with the lateral aligner 240 or the register aligner 270, and then terminates the process.

Through the determination of alignment modes according to the embodiment, the alignment operations of the lateral aligner 240 and the register aligner 270 are separately activated or inactivated depending on the predetermined parameters (the number to be collected, basis weight, and process mode) on sheets to be collected in the collector 220.

The conveyance of sheets in the intermediate conveying unit 200 under the control of the intermediate conveyance controller 504 will now be explained.

Figure 8:
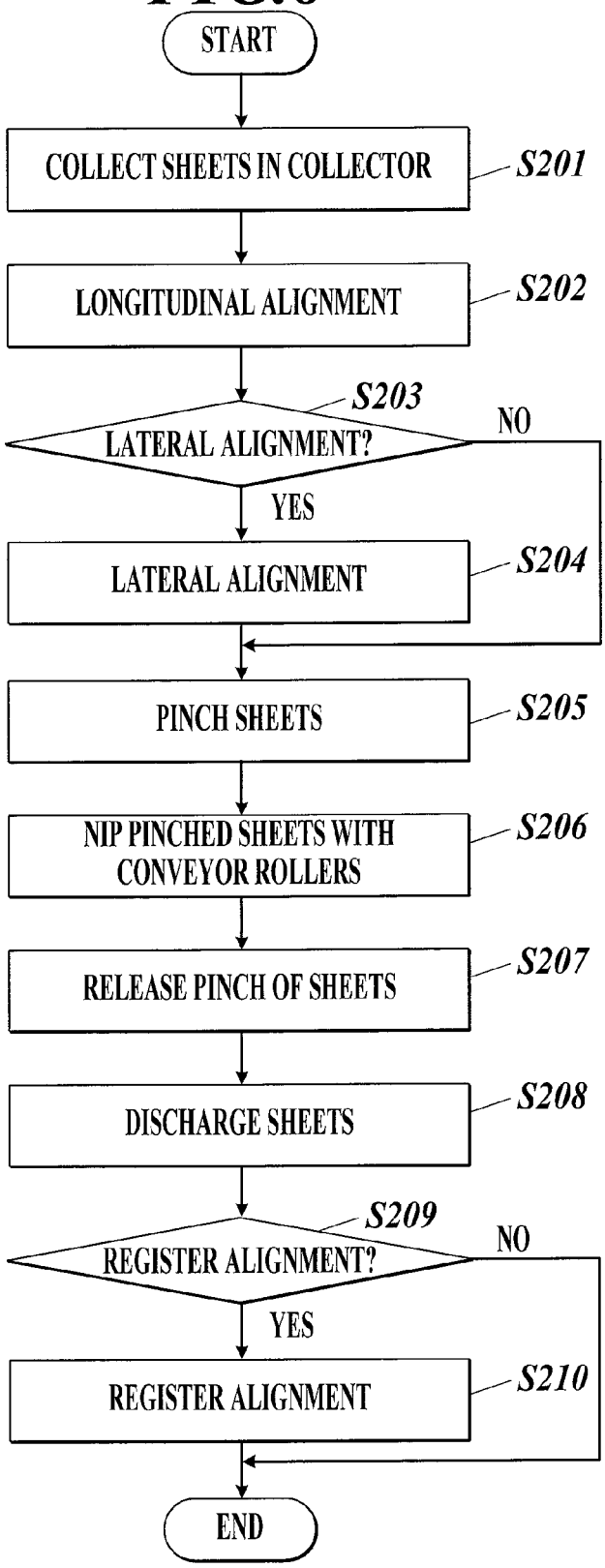
FIG. 8 is a flowchart illustrating a sheet conveying process in an intermediate conveying unit.

FIG. 8 is a flowchart illustrating the sheet conveying process in the intermediate conveying unit 200.

In Step S201, the intermediate conveyance controller 504 controls the collector 220 to collect the predetermined number of sheets, which are received through the receiver 210 from the image forming unit 100.

In Step S202, the intermediate conveyance controller 504 controls the longitudinal aligner 230 for the longitudinal alignment of the sheets collected in the collector 220.

In Step S203, the intermediate conveyance controller 504 determines whether the lateral alignment with the lateral aligner 240 is adopted for the longitudinally aligned sheets in the determination of alignment modes. If the lateral alignment with the lateral aligner 240 is not adopted (Step S203: No), the process goes to Step S205.

If the lateral alignment with the lateral aligner 240 is adopted (Step S203: Yes), the process goes to Step S204, and the intermediate conveyance controller 504 controls the lateral aligner 240 to align the longitudinally aligned sheets in the lateral direction.

In specific, the intermediate conveyance controller 504 controls the driver 243 to drive the upper alignment plates 241 and 241 and the lower alignment plates 242 and 242 to slide closer to the opposed plate in the Y direction and push the lateral edges across the width of the sheets. This configuration can ensure the lateral alignment regardless of unevenness in the widths of the sheets. The configuration can also match the widthwise center of the sheets with the widthwise center of the conveying path.

In Step S205, the intermediate conveyance controller 504 controls the grippers 232 and 232 to pinch the sheets near the widthwise center, which are supported by the stopper 231.

In Step S206, the intermediate conveyance controller 504 controls the conveyor rollers 261*a* and 261*b* to nip the pinched sheets.

In Step S207, the intermediate conveyance controller 504 controls the grippers 232 and 232 to release the sheets.

In Step S208, the intermediate conveyance controller 504 controls the discharge of the sheets.

In specific, the intermediate conveyance controller 504 controls the conveyor rollers 261*a* and 261*b* to convey the sheets toward the guide plates 262*a* and 262*b* via the rollers 263*a* and 263*b*.

In Step S209, the intermediate conveyance controller 504 determines whether the register alignment with the register aligner 270 is adopted for the sheets discharged from the collector 220 in the determination of alignment modes. If the register alignment with the register aligner 270 is not adopted (Step S209: No), the intermediate conveyance controller 504 controls the register rollers 271 and 272 to rotate forward in the moving direction of the sheets for conveying the sheets to the subsequent processor, and then terminates the process.

If the register alignment with the register aligner 270 is adopted (Step S209: Yes), the process proceeds to Step S210. In Step S210, the intermediate conveyance controller 504 controls the register aligner 270 for the register alignment, controls the conveyance of the sheet to the subsequent processor, and then terminates the process.

In specific, the intermediate conveyance controller 504 controls the driver 273 to rotate the register rollers 271 and 272 in the direction opposite to the moving direction of the sheet for the predetermined period and receive the front edge of the sheet abutting the register rollers 271 and 272 for the predetermined period, to warp the sheet. The intermediate conveyance controller 504 then controls the driver 273 to rotate the register rollers 271 and 272 forward in the moving direction of the sheet. This operation can correct the inclination of the sheet if such inclination has been caused during the conveyance, and can convey the sheet without inclination to the subsequent processor.

As described above, the sheet processing apparatus according to the embodiment includes the lateral aligner 240 to push the lateral edges inward across the width of a sheet conveyed from the upstream side for alignment of the sheet, the width being orthogonal to the moving direction of the sheet; the register aligner 270 to receive the front edge of the sheet conveyed from the upstream side and abutting the register aligner 270 for the predetermined period for alignment of the sheet; the driver 243 to drive the lateral aligner 240; the driver 273 to drive the register aligner 270; and the intermediate conveyance controller 504 to control operations of the driver 243 and the driver 273. The intermediate conveyance controller 504 activates or inactivates the driver 243 and the driver 273 depending on the predetermined parameters on the conveyed sheet.

This configuration can adopt appropriate alignment for each group of sheets depending on the predetermined parameters on the sheets, to properly correct the deviation of the sheets from the moving direction and stably convey the sheets to the subsequent process.

According to the embodiment, the intermediate conveyance controller 504 determines whether the basis weight of the conveyed sheet is higher than the predetermined weight on the basis of the predetermined parameters. If the basis weight of the sheet is higher than the predetermined weight; then the intermediate conveyance controller 504 activates the lateral aligner 240 alone; otherwise the intermediate conveyance controller 504 activates both the lateral aligner 240 and the register aligner 270.

This configuration can switch the drive between the lateral aligner 240 and the register aligner 270 depending on the basis weight of the sheet.

In specific, a sheet (e.g., thick paper) having a basis weight higher than the predetermined weight is centered by the lateral aligner 240 and then conveyed to the subsequent process without the register alignment with the register aligner 270. That is, the register alignment is not adopted for a sheet such as a thick paper unsuitable for the register alignment.

A sheet (e.g., thin paper) having a basis weight not higher than the predetermined weight is centered by the lateral aligner 240 and then straighten by the register aligner 270, to be more accurately aligned.

The activation of appropriate alignment for each sheet and the proper correction of the deviation of the sheet from the moving direction lead to stable conveyance of the sheet to the subsequent process.

The sheet processing apparatus according to the embodiment further includes the collector 220 to collect one or more sheets conveyed from the upstream side. The lateral aligner 240 aligns the sheets collected in the collector 220, while the register aligner 270 aligns the sheets discharged from the collector 220. The intermediate conveyance controller 504 determines whether a single sheet is to be collected in the collector 220 on the basis of the predetermined parameters. If a single sheet is to be collected, the intermediate conveyance controller 504 determines whether the basis weight of the conveyed sheet is higher than the predetermined weight.

This configuration can switch the drive between the lateral aligner 240 and the register aligner 270 depending on the basis weight of the sheet, if a single sheet is to be collected in the collector 220.

In specific, if a single sheet (e.g., thick paper) having a basis weight higher than the predetermined weight is to be collected in the collector 220, the sheet is centered by the lateral aligner 240 in the collector 220 and then conveyed to the subsequent process without the register alignment with the register aligner 270. That is, the register alignment is not adopted for a sheet such as a thick paper unsuitable for the register alignment.

If a single sheet (e.g., thin paper) having a basis weight not higher than the predetermined weight is to be collected in the collector 220, the sheet is centered by the lateral aligner 240 in the collector 220 and then straighten by the register aligner 270, to be more accurately aligned.

The activation of appropriate alignment for each sheet and the proper correction of the deviation of the sheet from the moving direction lead to stable conveyance of the sheet to the subsequent process.

If two or more sheets are to be collected in the collector 220, the intermediate conveyance controller 504 activates the lateral aligner 240 alone.

If two or more sheets are to be collected in the collector 220, the stacked sheets are aligned in the lateral direction with the lateral aligner 240 in the collector 220 and then conveyed to the subsequent process without the register alignment with the register aligner 270. That is, the register alignment is not adopted for stacked sheets unsuitable for the register alignment.

The activation of appropriate alignment for stacked sheets and the proper correction of the deviation of the sheets from the moving direction lead to stable conveyance of the sheets to the subsequent process.

According to the embodiment, if a single sheet having a basis weight not higher than the predetermined weight is to be collected in the collector 220, the intermediate conveyance controller 504 determines whether any subsequent process requires centering of the sheet in the width direction on the basis of the predetermined parameters. If any subsequent process requires the centering of the sheet in the width direction; then the intermediate conveyance controller 504 activates both the lateral aligner 240 and the register aligner 270; otherwise the intermediate conveyance controller 504 activates the register aligner 270 alone.

This configuration can skip the lateral alignment to a single sheet (e.g., thin paper) having a basis weight not higher than the predetermined weight and collected in the collector 220, unless any subsequent process requires the centering of the sheet in the width direction, resulting in high productivity.

Appropriate alignment can therefore be adopted depending on the subsequent processes.

According to the embodiment, if a single sheet having a basis weight higher than the predetermined weight is to be collected in the collector 220, the intermediate conveyance controller 504 determines whether any subsequent process requires centering of the sheet in the width direction on the basis of the predetermined parameters. If any subsequent process requires the centering of the sheet in the width direction; then the intermediate conveyance controller 504 activates the lateral aligner 240; otherwise the intermediate conveyance controller 504 does not activate the lateral aligner 240.

This configuration can skip the lateral alignment to a single sheet (e.g., thick paper) having a basis weight higher than the predetermined weight collected in the collector 220, unless any subsequent process requires centering of the sheet in the width direction, resulting in high productivity.

Appropriate alignment can therefore be adopted depending on the subsequent processes.

According to the embodiment, the path of the sheet between the lateral aligner 240 and the register aligner 270 includes the curved conveying path 264.

Such a curved conveying path occupies a smaller space in the apparatus than that of a straight conveying path. Although a sheet (in particular, a sheet having a basis weight not higher than the predetermined weight) conveyed through the curved conveying path 264 readily deviates, the appropriate alignment depending on the parameters on the sheet according to the embodiment enables stable conveyance of the sheet through the curved conveying path 264.

According to the embodiment, the lateral aligner 240 includes the upper alignment plates 241 and 241 and the lower alignment plates 242 and 242, which are reciprocatable in the width direction and align the lateral edges across the width of the sheet. The intermediate conveyance controller 504 controls the distance between the upper alignment plates 241 and 241 and the distance between the lower alignment plates 242 and 242 to be equal to or slightly larger than the width of the sheet during the charge and/or discharge of the sheet into and/or from the collector 220.

The upper alignment plates 241 and 241 and the lower alignment plates 242 and 242 therefore guide the sheet during the charge and/or discharge of the sheet through the first conveying path 201, to prevent irregular movements of the sheet. This configuration can improve the accuracy of the lateral alignment.

According to the embodiment, the collector 220 includes the creaser 250 to score the sheet aligned with the lateral aligner 240.

The sheet is centered in the width direction to the widthwise center of the conveying path through the appropriate lateral alignment and then scored in the collector 220. This configuration can improve the accuracy of the scoring process.

The sheet processing apparatus according to the embodiment further includes the slitter 280 downstream of the register aligner 270 in the moving direction of the sheet, the slitter 280 trimming off margins along the lateral edges across the width of the conveyed sheet.

The sheet is conveyed without deviation from the widthwise center of the conveying path through the appropriate lateral and register alignment and then trimmed to remove the margins. This configuration can improve the accuracy of the trimming process.

Although the necessity of the centering of a sheet in the width direction in the subsequent processes is determined in the alignment mode determining process according to the embodiment, such determination may be omitted.

Figure 9:
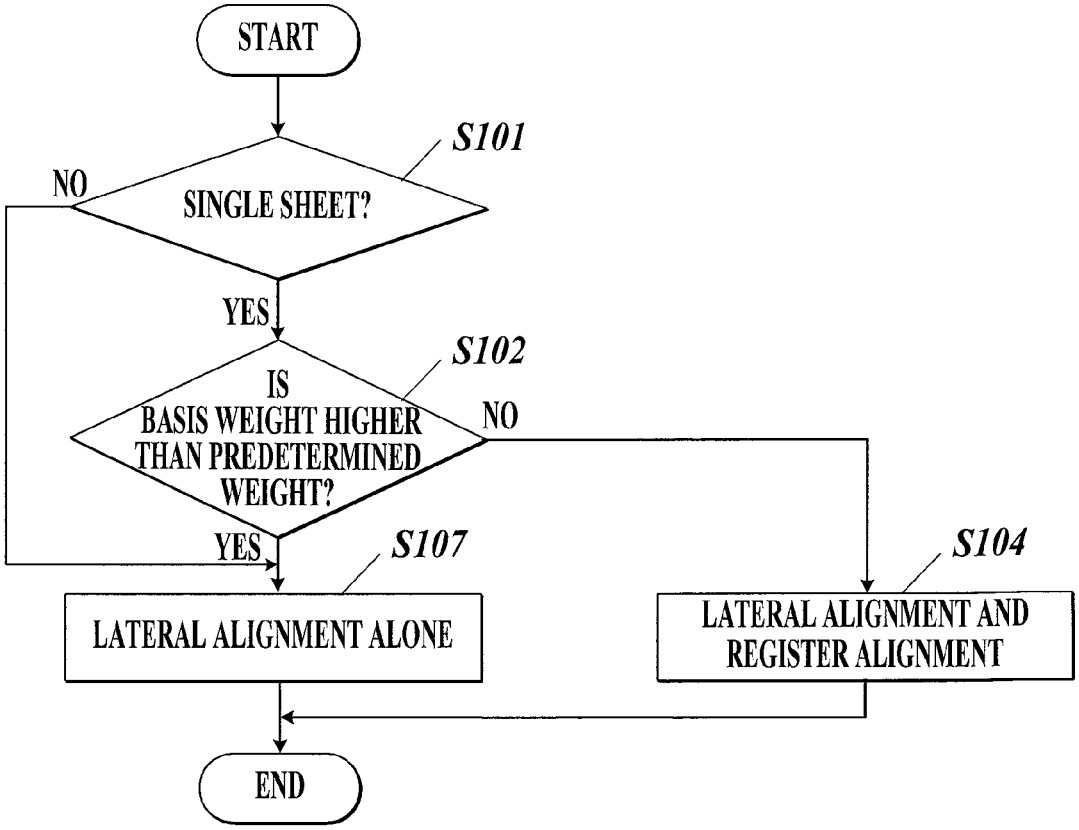
FIG. 9 is a flowchart illustrating a modification of the alignment mode determining process in FIG. 7.

In this case, with reference to FIG. 9, if a single sheet is to be collected in the collector 220 and if the basis weight of the sheet is not higher than the predetermined weight (Step S102: No), the intermediate conveyance controller 504 adopts the alignment with both the lateral aligner 240 and the register aligner 270. If two or more sheets are to be collected in the collector 220 (Step S101: No), or if a single sheet is to be collected in the collector 220 and if the basis weight of the sheet is higher than the predetermined weight (Step S102: Yes), the intermediate conveyance controller 504 adopts the alignment with the lateral aligner 240 alone.

This configuration can also adopt appropriate alignment depending on the number of sheets to be collected in the collector 220 and the basis weight of the sheet, to enable stable conveyance of the sheet to the subsequent process.

According to the embodiment, a sheet is pinched with the grippers 232 and 232 after the alignment with the longitudinal aligner 230, or after the alignment with both the longitudinal aligner 230 and the lateral aligner 240. Alternatively, the grippers 232 and 232 may be replaced with the conveyor rollers 261*a* and 261*b*. In this case, Steps S205 and S206 in FIG. 8 are simultaneously executed. Furthermore, the grippers 232 and 232 may be omitted.

The intermediate conveying unit 200 includes the creaser 250 and the slitter 280 according to the embodiment. If the intermediate conveying unit 200 does not perform scoring or trimming, these components may be omitted.

According to the embodiment, the sheet is aligned in the longitudinal direction with the longitudinal aligner 230 and then aligned in the lateral direction with the lateral aligner 240. Alternatively, the longitudinal alignment and the lateral alignment may be simultaneously performed.

Although the conveying path 264 is curved according to the embodiment, the conveying path 264 may be straight. In this case, a sheet (in particular, a sheet having a basis weight not higher than the predetermined weight) conveyed through the curved conveying path 264 does not readily deviate; hence a single sheet having such a low basis weight may be subjected to the register alignment alone without the lateral alignment.

According to the embodiment, sheets conveyed from the upstream side, i.e., received from the image forming unit 1 are collected in the collector 220. Alternatively, for example, the intermediate conveying unit 200 may further include any processor between the receiver 210 and the collector 220, so that sheets conveyed from the processor are collected in the collector 220. Furthermore, sheets received from any other device than the image forming unit 1 may be collected in the collector 220.

The entire disclosure of Japanese Patent Application No. 2013-127418 filed on Jun. 18, 2013 including description, claims, drawings, and abstract are incorporated herein by reference in its entirety.

What is claimed is:

1. A sheet processing apparatus comprising:

a first aligner to push lateral edges of a sheet inward across a width direction of the sheet conveyed from an upstream side for alignment of the sheet, the width direction being orthogonal to a moving direction of the sheet;

a second aligner to abut a front edge of the sheet conveyed from the upstream side for a predetermined period of time for alignment of the sheet;

a first aligner driver to drive the first aligner;

a second aligner driver to drive the second aligner; and a controller to control an operation of the first aligner driver and an operation of the second aligner driver according to a combination of a plurality of predetermined parameters which is set for each job, wherein:

the controller activates or inactivates the first aligner driver and the second aligner driver depending on the combination of the plurality of predetermined parameters which is set for each job, the controller determines whether a basis weight of the conveyed sheet is higher than a predetermined weight on the basis of one of the predetermined parameters, and the controller further determines whether a condition is met with respect to another one of the predetermined parameters, if the basis weight of the sheet is higher than the predetermined weight, and depending on a determination result with respect to the other one of the predetermined parameters, the controller activates the first aligner driver alone, and if the basis weight of the sheet is not higher than the predetermined weight, and depending on the determination result with respect to the other one of the predetermined parameters, the controller activates both the first aligner driver and the second aligner driver.

2. The sheet processing apparatus according to claim 1, further comprising a collector to collect one or more sheets conveyed from the upstream side, wherein:

the first aligner aligns the one or more sheets collected in the collector, the second aligner aligns the one or more sheets discharged from the collector, the controller determines whether a single sheet is to be collected in the collector on the basis of one of the predetermined parameters, if a single sheet is to be collected in the collector, the controller determines whether the basis weight of the conveyed sheet is higher than the predetermined weight, (i) if the basis weight of the sheet is higher than the predetermined weight, the controller activates the first aligner driver alone, and (ii) if the basis weight of the sheet is not higher than the predetermined weight, the controller activates both the first aligner driver and the second aligner driver, and if two or more sheets are to be collected in the collector, the controller activates the first aligner driver alone.

3. The sheet processing apparatus according to claim 2, wherein:

if a single sheet is to be collected in the collector and if the basis weight of the sheet is not higher than the predetermined weight, the controller determines whether any subsequent process requires centering of the sheet in the width direction on the basis of another one of the predetermined parameters, and if any subsequent process requires the centering of the sheet in the width direction, the controller activates both the first aligner driver and the second aligner driver, and if no subsequent process requires the centering of the sheet in the width direction, the controller activates the second aligner driver alone.

4. The sheet processing apparatus according to claim 2, wherein:

if a single sheet is to be collected in the collector and if the basis weight of the sheet is higher than the predetermined weight, the controller determines whether any subsequent process requires centering of the sheet in the width direction on the basis of another one of the predetermined parameters, and (i) if any subsequent process requires the centering of the sheet in the width direction, the controller activates the first aligner driver, and (ii) if no subsequent process requires the centering of the sheet in the width direction, the controller does not activate the first aligner driver.

5. The sheet processing apparatus according to claim 1, wherein a sheet conveying path between the first aligner and the second aligner includes a curved conveying path.

6. The sheet processing apparatus according to claim 1, wherein:

the first aligner includes a pair of alignment members reciprocatable in the width direction to align the lateral edges across the width direction of the sheet, and the controller controls a distance between the alignment members according to a width of the sheet during at least one of charge of the sheet into a collector and discharge of the sheet from the collector.

7. The sheet processing apparatus according to claim 1, further comprising a collector which includes a creaser to score the sheet which is aligned with the first aligner.

8. The sheet processing apparatus according to claim 1, further comprising a trimmer downstream of the second aligner in the moving direction of the sheet, the trimmer trimming off margins along the lateral edges across the width direction of the conveyed sheet.

9. An image forming system comprising:

an image forming unit to form an image on a sheet; and the sheet processing apparatus according to claim 1 to perform a predetermined process on the sheet having the image formed by the image forming unit.

10. A sheet processing apparatus comprising:

a first aligner to push lateral edges of a sheet inward across a width direction of the sheet conveyed from an upstream side for alignment of the sheet, the width direction being orthogonal to a moving direction of the sheet;

a second aligner to abut a front edge of the sheet conveyed from the upstream side for a predetermined period of time for alignment of the sheet;

a first aligner driver to drive the first aligner;

a second aligner driver to drive the second aligner; and a controller to control operations of the first aligner driver and the second aligner driver, wherein:

the controller activates or inactivates the first aligner driver and the second aligner driver depending on a predetermined parameter on the conveyed sheet, the controller determines whether a basis weight of the conveyed sheet is higher than a predetermined weight on the basis of the predetermined parameter, if the basis weight of the sheet is higher than the predetermined weight, the controller activates the first aligner driver alone, and if the basis weight of the sheet is not higher than the predetermined weight, the controller activates both the first aligner driver and the second aligner driver.

11. A sheet processing apparatus comprising:

a first aligner to push lateral edges of a sheet inward across a width direction of the sheet conveyed from an upstream side for alignment of the sheet, the width direction being orthogonal to a moving direction of the sheet;

a second aligner to abut a front edge of the sheet conveyed from the upstream side for a predetermined period of time for alignment of the sheet;

a collector to collect one or more sheets conveyed from the upstream side, a first aligner driver to drive the first aligner;

a second aligner driver to drive the second aligner; and a controller to control operations of the first aligner driver and the second aligner driver, wherein:

the controller activates or inactivates the first aligner driver and the second aligner driver depending on a predetermined parameter on the conveyed sheet, the first aligner aligns the one or more sheets collected in the collector, the second aligner aligns the one or more sheets discharged from the collector, the controller determines whether a single sheet is to be collected in the collector on the basis of the predetermined parameter, if a single sheet is to be collected in the collector, the controller determines whether a basis weight of the conveyed sheet is higher than a predetermined weight on the basis of the predetermined parameter, and (i) if the basis weight of the sheet is higher than the predetermined weight, the controller activates the first aligner driver alone, and (ii) if the basis weight of the sheet is not higher than the predetermined weight, the controller activates both the first aligner driver and the second aligner driver, and if two or more sheets are to be collected in the collector, the controller activates the first aligner driver alone.

12. The sheet processing apparatus according to claim 11, wherein:

if a single sheet is to be collected in the collector and if the basis weight of the sheet is not higher than the predetermined weight, the controller determines whether any subsequent process requires centering of the sheet in the width direction on the basis of the predetermined parameter, and if any subsequent process requires the centering of the sheet in the width direction, the controller activates both the first aligner driver and the second aligner driver, and if no subsequent process requires the centering of the sheet in the width direction, the controller activates the second aligner driver alone.

13. The sheet processing apparatus according to claim 11, wherein:

if a single sheet is to be collected in the collector and if the basis weight of the sheet is higher than the predetermined weight, the controller determines whether any subsequent process requires centering of the sheet in the width direction on the basis of the predetermined parameter, and (i) if any subsequent process requires the centering of the sheet in the width direction, the controller activates the first aligner driver, and (ii) if no subsequent process requires the centering of the sheet in the width direction, the controller does not activate the first aligner driver.

* * * * *